US007030374B2

(12) United States Patent
Franzen

(10) Patent No.: US 7,030,374 B2
(45) Date of Patent: Apr. 18, 2006

(54) ION FRAGMENTATION IN RF ION TRAPS BY ELECTRON CAPTURE WITH MAGNETIC FIELD

(75) Inventor: Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 27 days.

(21) Appl. No.: 10/859,924

(22) Filed: Jun. 3, 2004

(65) Prior Publication Data

US 2005/0017165 A1 Jan. 27, 2005

(30) Foreign Application Priority Data

Jun. 5, 2003 (DE) ..... 103 25 582

(51) Int. Cl.
*H01J 39/34* (2006.01)

(52) U.S. Cl. ..... 250/292; 250/293

(58) Field of Classification Search ..... 250/292, 250/293, 290

See application file for complete search history.

(56) References Cited

U.S. PATENT DOCUMENTS

| | | | | |
|---|---|---|---|---|
| 4,563,579 A | 1/1986 | Kellerhals et al. | | |
| 6,653,622 B1 * | 11/2003 | Franzen | ..... | 250/282 |
| 6,800,851 B1 * | 10/2004 | Zubarev et al. | ..... | 250/292 |
| 2002/0092980 A1 * | 7/2002 | Park | ..... | 250/288 |
| 2004/0155180 A1 * | 8/2004 | Zubarev | ..... | 250/281 |

FOREIGN PATENT DOCUMENTS

| | | | |
|---|---|---|---|
| DE | 37 33 853 | A1 | 4/1989 |
| DE | 100 58 706 | C1 | 2/2002 |
| GB | 935184 | A | 8/1963 |
| GB | 1522968 | A | 8/1978 |
| GB | 2372877 | A | 9/2002 |
| GB | 2391695 | A | 2/2004 |
| GB | 0412404.6 | | 10/2004 |
| WO | WO 02/78048 | A1 | 11/2002 |
| WO | WO 03/102545 | A2 | 12/2003 |

OTHER PUBLICATIONS

DE, Search Report, Jun. 5, 2003.

* cited by examiner

*Primary Examiner*—Kiet T. Nguyen

(57) ABSTRACT

The invention relates to a method and device for the fragmentation of macromolecules, preferably biomolecules, by electron capture in RF quadrupole ion trap mass spectrometers according to Wolfgang Paul. The invention comprises steering a beam of low energy electrons through a magnetic guide field exactly into an ion cloud in the center of the ion trap.

11 Claims, 3 Drawing Sheets

ION FRAGMENTATION IN RF ION TRAPS BY ELECTRON CAPTURE WITH MAGNETIC FIELD

FIELD OF THE INVENTION

The invention relates to a method and device for the fragmentation of macromolecules, preferably biomolecules, by electron capture in RF quadrupole ion trap mass spectrometers according to Wolfgang Paul.

BACKGROUND OF THE INVENTION

Ion traps according to Paul comprise a ring electrode and two end cap electrodes, the ring electrode usually being supplied with the storage RF voltage, although other types of operation are possible. In the interior of the ion trap, ions can be stored in the essentially quadrupolar RF field. The ion traps can be used as mass spectrometers by ejecting the stored ions selectively according to their mass and measuring them using a secondary-electron multiplier. Several different methods for the ion ejection have been published; they will not be discussed further here.

The RF voltage on the ring electrode is very high, in customary ion trap mass spectrometers between 15 and 30 kilovolts (peak-to-peak). The frequency is around one megahertz. In the interior, a predominantly quadrupolar RF field is generated which oscillates with the RF voltage and drives the ions above a threshold mass towards the center, causing them to execute so-called secular oscillations in this field. The restoring forces in the ion trap are sometimes described by a so-called pseudo-potential which is determined by a temporal averaging of the forces of the real potential. In the center there is a saddle point of the oscillating real potential, which decreases quadratically, depending on the phase of the RF voltage, from the saddle point towards the ring electrode, and increases quadratically from the saddle point to the end cap electrodes (or the other way round in other RF phases).

Ion trap mass spectrometers have characteristics which make them of interest for many types of analyses. In particular, they can be used to isolate and fragment selected types of ions (so-called parent ions) in the ion trap. The spectra of these fragment ions are called "fragment ion spectra" or "daughter ion spectra" of the parent ions in question. It is also possible to measure "granddaughter ion spectra" as fragment ion spectra of selected daughter ions. Until now, the ions have been predominantly fragmented by a multitude of collisions with a collision gas, the oscillations of the ions to be fragmented being excited by a dipolar alternating field in such a way that the ions in the collisions can collect energy, a step which ultimately leads to the decay of the ions.

The ions can be either generated in the interior of the ion trap or introduced from outside. A collision gas in the ion trap ensures that the ion oscillations initially present are decelerated in the quadrupole RF field; the ions then collect as a small cloud in the center of the ion trap. The diameter of the cloud in normal ion traps is around one millimeter; it is determined by an equilibrium between the centripetal pseudo-force of the RF field (the restoring force of the pseudo-potential) and the repulsive coulomb forces between the ions. The internal dimensions of the ion trap are usually characterized by a separation of the end caps of around 14 millimeters; the ring diameter is around 14 to 20 millimeters.

A popular type of ionization of large biomolecules is the electrospray method (ESI=electro spray ionization), which ionizes ions at atmospheric pressure outside the mass spectrometer. These ions are then brought via inlet systems of a known type into the vacuum of the mass spectrometer and from there into the ion trap.

This ionization generates practically no fragment ions, the ions being essentially those of the molecule. With electrospray, multiply charged ions of the molecules do frequently occur, however. As a result of the lack of almost any fragment ion during the ionization process, the information from the mass spectrum is limited to the molecular weight; there is no information about internal molecular structures which can be used for the further identification of the substances present. This information can only be obtained by acquiring fragment ion spectra.

Recently, a particularly favorable method for the fragmentation of biomolecules, mainly peptides and proteins, has been developed in ion cyclotron resonance or Fourier transform mass spectrometry. It consists of allowing electrons to be captured by multiply positively charged ions, during which the ionization energy (more precisely: the proton attachment energy) released leads to the fragmentation of the usually chain-shaped molecules. The method is known as ECD (electron capture dissociation). If the molecules were doubly charged, one of the two fragments created remains as an ion. In this process, the fragmentation follows extremely simple rules (for specialists: there are predominantly c-cleavages and only a few a-cleavages and z-cleavages between the amino acids of a peptide), so that it is very simple to draw conclusions relating to the structure of the molecule from the fragmentation pattern. In particular, the sequence of peptides or proteins is easy to see from the fragmentation spectrum. The interpretation of these ECD fragment spectra is simpler than the interpretation of collision generated fragment spectra.

It is also possible to fragment triply or multiply charged ions in this way, but the method really shines in the case of doubly charged ions. If an electrospray ionization is applied to peptides, the doubly charged ions are also the most prevalent ions, as a rule. Electrospray ionization is a method of ionization which is particularly frequently used for biomolecules for the purpose of mass spectrometric analysis in ion traps.

For fragmentation by electron capture, the kinetic energy of the electrons must be very low, since otherwise there can be no capture. In practice, one offers electrons with an energy which lies just above the thermal energy of the electrons at room temperature. In the extremely strong magnetic fields of Fourier transform mass spectrometers this is very successful, because the electrons simply drift along the magnetic field lines until they reach the cloud of ions. A second energy regime between 3 and 30 electron volts leads to so-called "hot electron capture dissociation", also a favorable dissociation method.

In electric RF ion traps according to Paul, it is difficult to create such an ion capture. As a rule, ion traps have perforations in the end caps through which the ions can enter and exit. In the case of internal ionization, the ionizing radiation is also introduced through this end cap perforation. An electron beam is usually used for this. The strongly oscillating RF field in the interior of the ion trap either accelerates the electrons in such a way that they rush through the trap volume with considerable energy or, alternatively, the electrons are turned back already at the entrance hole. These electrons are not particularly suitable for electron capture. Only for an extraordinarily short period of time, fractions of nanoseconds at the zero crossover of the high voltage, is there no field, and low energy electrons can reach the ion cloud with low energies. These few low energy electrons are in competition with very many more electrons which are accelerated to considerable energies, however; the fragmentation by high energy electron collision exceeds the fragmentation by electron capture many times over, thus making the fragment ion spectra useless.

In patent specification DE 100 58 706 C1 (U.S. Pat. No. 6,653,622), a method for ion trap mass spectrometers according to Paul has now been elucidated by which, in a simplest embodiment, the electrons are injected into the ion trap through an additional opening mounted in the ring electrode, the electron source being at such a high positive potential that it is equaled or exceeded by the oscillating potential of the center of the ion trap for only a very short period of time, only for a few nanoseconds in the maximum of the RF voltage. The electrons can reach the ion cloud only during these few nanoseconds, but they are decelerated to a mere fraction of their kinetic energy and are thus ideal for electron capture. At all other times, the electrons cannot reach the center of the ion trap at all because the potential of the center is more negative than the potential of the electron source and it repels the electrons, which are always negatively charged.

The deceleration of the ions in this case takes place en route from the ring electrode to the center, during which time the electrons must climb the saddle-shaped potential mountain between the two end caps (see FIGS. 3 and 4). The ion cloud is at the saddle point. The saddle potential focuses the electrons on the ion cloud in the plane formed by the beam axis of the electron beam and the z-axis, which passes through both end caps, (the "end cap plane"); electrons deviating laterally are forced back onto the correct path in the saddle channel again.

Unfortunately, there is no focusing of the electron beam in the other plane, the center plane of the ring ("ring plane"), instead, a defocusing occurs because the electrons here do not climb the potential of the center in a saddle, but rather on the outer shell of a rotation paraboloid. Only electrons which arrive exactly on the ideal line have a chance of climbing the mountain, but they also find themselves permanently in unstable equilibrium at this time and this causes them to immediately leave the ideal line each time there is the slightest perturbation. This defocusing has, until now, prevented the electrons reaching at the cloud.

The collision fragmentation in the ion trap usually occurs at an RF voltage of between one fifth and one third of the maximum voltage used for the scanning. This relatively high voltage is necessary in order to achieve sufficient energy transfer during the collisions. This voltage has the disadvantage, however, that fragment ions of low mass can no longer be held in the trap. It is therefore not possible to identify the complete sequence of a peptide because the small fragments with either one, two or three amino acids are lost.

The ion capture in the ion trap does not suffer from this disadvantage, if it can be created in the first place. This type of fragmentation can also take place at lower RF voltages so that fragment ions of low mass, i.e. those with one, two or three amino acids, can be held and detected in the trap.

For a fragmentation by electron capture, one option is that, after isolating doubly charged ions in the ion trap, an RF voltage of around 3 kilovolts (peak-to-peak), for example, is set, said voltage oscillating with a sine-shape at the ring in the potential range of −1.5 to +1.5 kilovolts against ground potential. The end cap electrodes are kept at ground potential. The center of the ion trap follows the ring voltage with approximately half of the ring electrode voltage if the inner radius of the ring electrode is 1.4 times the distance between the end cap electrodes, i.e. from around −750 to +750 volts. If the electron source is at a DC voltage potential of +750 volts, the electrons can only reach the center when the ring voltage in the voltage maximum is at +1.5 kilovolts and the center correspondingly at +750 volts. In this case, the electrons are accelerated outside the ion trap from the potential of the electron source (+750 V) to the potential of the ring electrode (+1.5 kV), thus receiving an energy of 750 electron-volts. In the interior of the ion trap, the kinetic energy of 750 electronvolts is decelerated to practically zero electron-volts again, because the center with the ion cloud is at the potential of +750 volts. At all other times, the center is at a more negative potential, the negative electrons are repelled.

Unfortunately, it has not yet proved possible to create the electron capture fragmentation in a quadrupole ion trap experimentally, because the electrons cannot reach the saddle point due to defocusing along the unstable potential increase in the plane of the ring.

SUMMARY OF THE INVENTION

The basic idea of the invention is to guide the electrons from the electron emitter to the ion cloud inside the ion trap by a magnetic field. The electrons may enter, in one embodiment, through the ring, to which an RF is applied, into the trap volume; there are guided in the magnetic field in such a way that no defocusing can take place in the ring plane. Even a very weak magnetic field is sufficient to achieve this, especially if the defocusing forces on the intended, unstable ideal trajectory are very weak and only increase in strength on leaving this trajectory. In other embodiments, the electrons may enter the ion trap through a perforation in the end cap electrode or through the gap between the ring and the end cap electrode.

The magnetic field can be a weak permanent field, since medium to heavy ions are scarcely deflected by such a field and so the magnetic field hardly disturbs the operation of the ion trap. The permanent field can be created by one or more permanent magnets with a closed yoke around the outside.

The magnetic field can also be created using an electromagnet with yoke. This has the advantage of being able to switch the magnetic field on and off. It then only needs to be switched on during the fragmentation.

A low AC voltage in a frequency range of some kilohertz between the end caps sweeps the electron beam to and fro in the ring plane and excites the ion cloud to oscillations between the end caps; in this way the electrons can meet all ions of the cloud, not only those in the exact center of the cloud.

Control of the Wehnelt cylinder of the electron gun allows to limit electron emission to the most favorable time interval of the RF period, avoiding the ionization of damping gas molecules in residual time intervals of the full period.

The invention also encompasses an ion trap mass spectrometer to carry out the method, with at least one opening in the ring electrode, with an electron source in front of the ring electrode and with a guiding magnetic field for the electrons.

BRIEF DESCRIPTION OF THE DRAWINGS

The above and further advantages of the invention may be better understood by referring to the following description in conjunction with the accompanying drawings in which.

DETAILED DESCRIPTION

Figure 1:
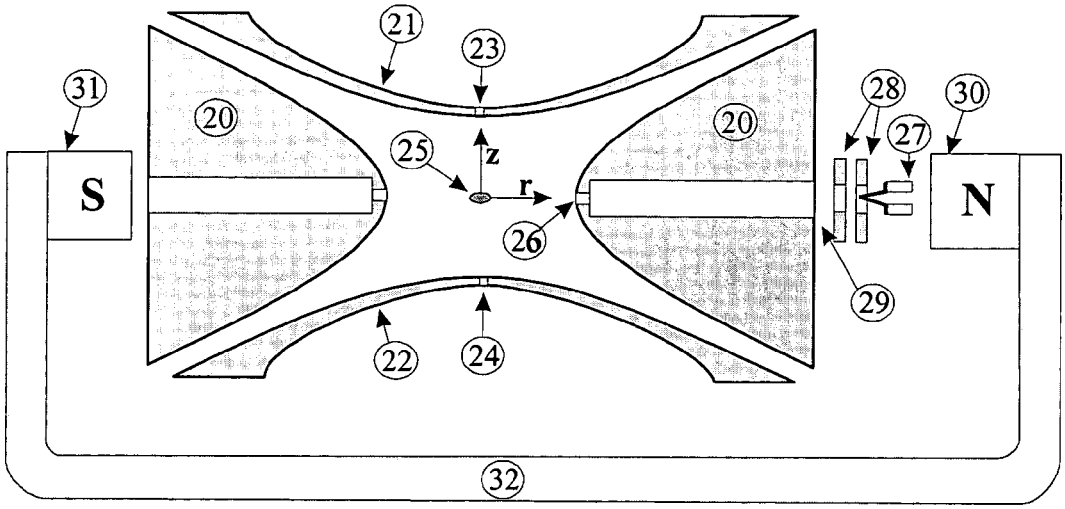
FIG. 1 illustrates an ion trap for the electron capture fragmentation with the additional magnetic field according to the invention.

A favorable embodiment of the invention is illustrated in FIG. 1 and shows the magnetic guiding field for the electrons according to the invention with the two magnetic poles (39, 31).

An electrospray ion source outside the mass spectrometer is used to ionize the biomolecules. It is assumed here that a mixture of digest peptides of a larger protein is to be analyzed. The ions are guided in the usual way through a capillary and subsequent pressure stages with ion guides into the ion trap, where they are trapped. An initial mass spectrum provides an overview of the digest peptides. If it is required to analyze one or more peptides to establish their sequence of amino acids, the doubly charged ions of this peptide are isolated by normal means; this means that, after intentionally overfilling the ion trap, all ions which are not doubly charged ions of this peptide are ejected. The overfill is selected in such a way that, after the isolation, the correct number of ions for fragmentation and measurement remain. The double charge can be recognized from the separation of the isotope lines, which is exactly ½ an atomic mass unit for doubly charged ions.

These doubly charged ions are decelerated into the center of the trap by a short waiting time of a few milliseconds by the ever-present collision gas. Here, they form a small cloud (25) of roughly one millimeter in diameter.

The ring electrode (20) of the ion trap is equipped with a hole (26) of around half a millimeter in diameter in a slightly wider bore (29). An electron emitter (27) with electrodes (28) for electron extraction and electron beam focusing is mounted in front of the bore hole (29). This electron emitter (27) is at the potential which the ion cloud (25) at the saddle point of the trap potential possesses at the time of its positive maximum.

On either side of the ring electrode (20), in the plane of the electron emitters (27), are the two poles (30, 31) of the magnet with yoke (32). The magnetic field is aligned parallel to the desired trajectory of the electrons. The magnet in this case can comprise weak permanent magnets, or it can be an electromagnet. In the case of an electromagnet, the yoke is enclosed by a solenoid (not shown). The electromagnet has the advantage that the magnetic field can be switched off during the remaining phases of the ion trap operation. It is favorable if the yoke extends in the plane of the ring electrode (20); in FIG. 1 it has been placed around the end cap (22) for reasons of clarity.

If the electron extraction is switched on by the electrodes (28), a fine beam of electrons is formed which is directed by the electric focusing of the switchable lens (28) and also, in particular, by the magnetic field between the magnetic poles (30) and (3), towards the entrance opening (29) of the bore in the ring electrode. This electron beam is driven back by the ring electrode as long as the RF potential of the ring electrode is more negative than the potential of the electron emitter. If, during the course of the RF period, the potential of the ring electrode becomes more positive, then the electrons are increasingly accelerated towards the ring electrode (20). They then enter the ion trap through the bore (29) and the tiny entrance (26), where they see an opposing, decelerating potential profile which they cannot completely climb. They are therefore reflected again. Only at the maximum of the potential of the RF period can the electrons penetrate as far as the saddle point (see (10) in FIG. 3) where the ion cloud (25) is located. On arrival in the ion cloud (25) they have been decelerated to a kinetic energy of practically zero. They are now initially trapped by the space charge potential of the ion cloud practically without any trapping losses, before being captured herein by the individual ions.

It is favorable to select the focusing of the electrons by means of the set of apertures (28) and to select the bore opening in such a way that focusing of the electron stream onto the small opening occurs only in the correct time phase.

The electrodes (28), called "Wehnelt electrodes," may optionally also be used for a time control of the electron emission during the RF period. Electrons may only be emitted in the most favorable time interval for the electrons reaching the ion cloud and being captured by the ions. This type of operation avoids the ionization of too much damping gas.

Figure 2:
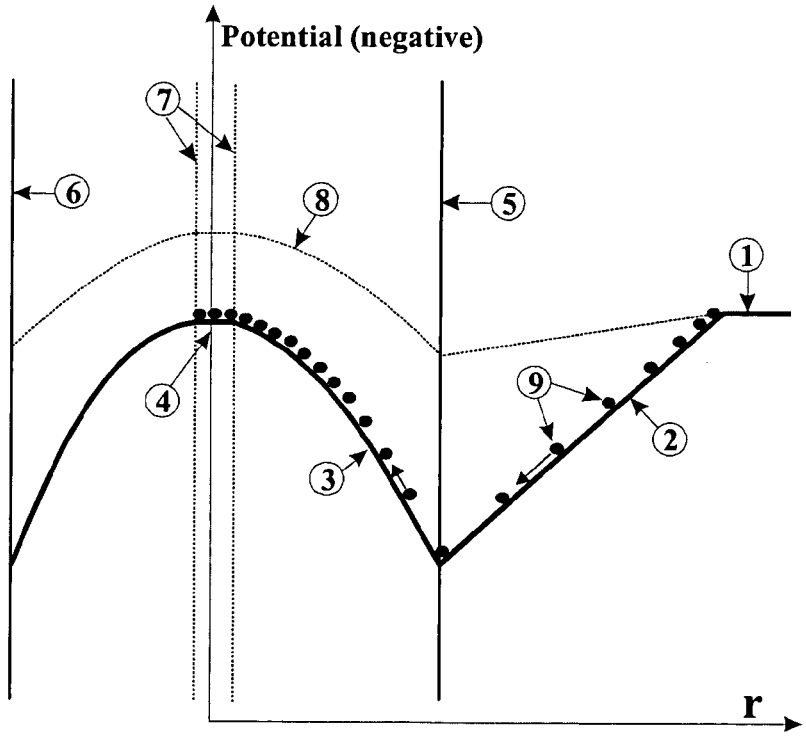
FIG. 2 shows the symbolic potential profile (1, 2, 3, 4) from the location of the electron source (1) in the ring plane (r-direction) to the location of the ion cloud (4) at the time of the voltage maximum of the RF period.

FIG. 2 shows schematically the potential profile (1, 2, 3, 4) from the location of the electron source (1) across the ring plane (r-direction) to the location of the ion cloud (4) at the time of the voltage maximum of the RF period. For negative potentials, the potential profile points upwards, so that electrons can schematically "roll down" the potentials in the way we normally imagine them to do.

The positions (5) and (6) symbolically represent the location of the ring electrode; the small ion cloud on the potential saddle (4) is located in the region (7). The electrons (9) first roll down the potential slope (2) between electron source potential (1) and the ring electrode (5), and are then decelerated on the rising potential slope (3) towards the potential (4) of the ion cloud. This potential profile occurs only during the few nanoseconds of the maximum potential of the high voltage period. The potential profile (8) illustrates a profile in another phase of the RF period. The direction to positive potentials points downwards, to negative potentials upwards, in order to make the rolling down of the electrons (9) clearer to see.

Figure 3:
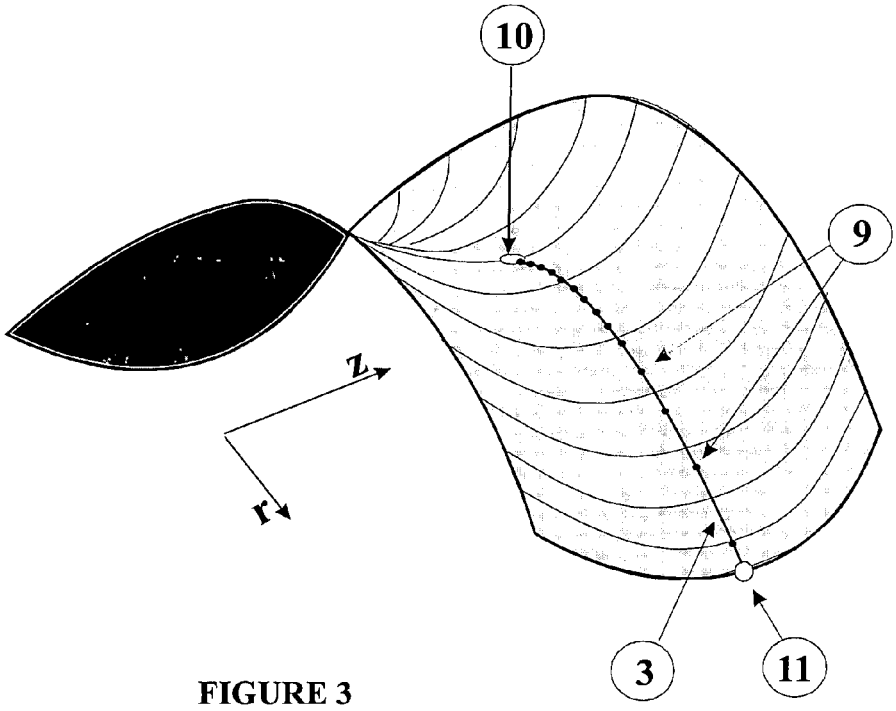
FIG. 3 shows the potential saddle across the r-z-plane, which is relatively easy for the electrons (9) to climb to reach the ion cloud. The electrons are automatically guided in this plane by the shape of the saddle. The electrons (9) are injected at point (11).
Figure 4:
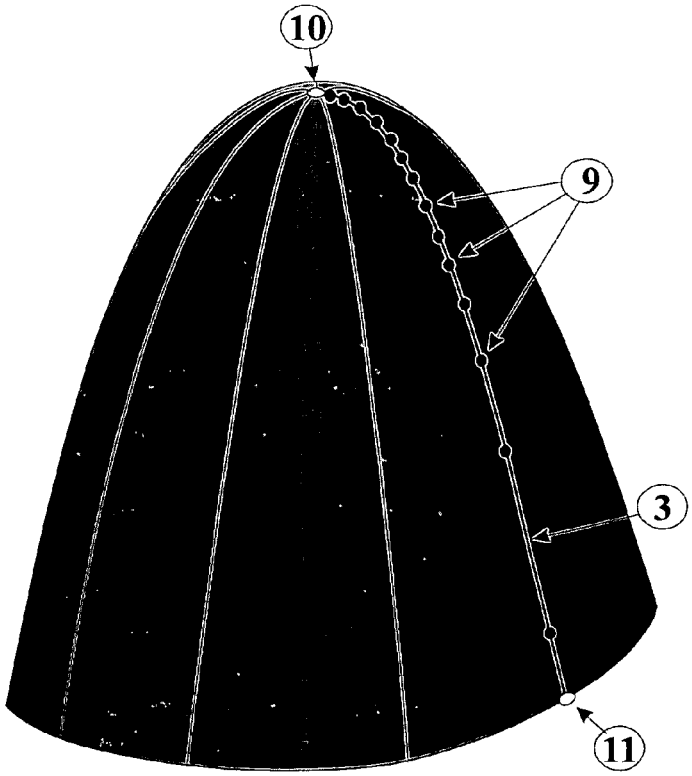
FIG. 4 shows the potential mountain across the ring plane which the electrons (9) must climb to reach the ion cloud (10). The electrons are defocused here, the slightest perturbation causing them to deviate laterally. They can be guided only by the magnetic field according to the invention.

FIGS. 3 and 4 illustrate the potential profile which the electron beam experiences in the interior of the ion trap, once in the ring plane (FIG. 4) and once in the plane transverse to the plane of the ring (FIG. 3).

FIG. 3 shows the very favorable potential saddle above the r-z-plane which the electrons (9) can very easily climb along the path (3) to reach the ion cloud (10) since, in this plane, they are automatically guided by the shape of the saddle. The electrons (9) are injected at point (11).

FIG. 4 illustrates the potential mountain which the electrons (9) must climb along the path (3) to reach the ion cloud (10), above the plane of the ring. This path is a path of constant instability for the electrons. The smallest perturbation, or the smallest deviation of the injection from the ideal line (3), causes the electrons to immediately deviate laterally. This is where the present invention comes into play: only by means of the magnetic field according to the invention can the electrons be guided with certainty to the ion cloud (10).

Figure 5:
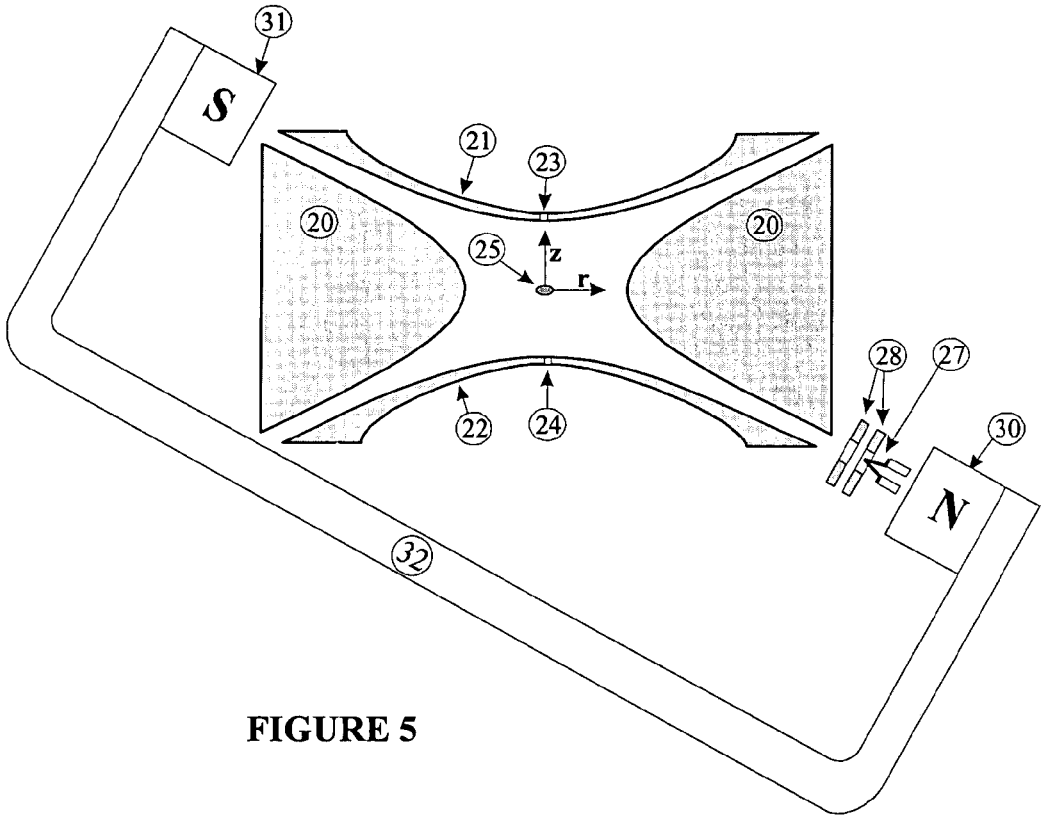
FIG. 5 exhibits an ion trap, wherein the electron beam enters through the gap between ring and end cap electrodes.

FIG. 5 presents a different embodiment of this invention: the electrons are injected into the ion trap through the gap between ring electrode and end cap electrode, again, guided by a magnetic field. The electrons can enter the ion trap only in such very short periods where the RF voltage just has its cross-over from positive to negative voltages or vice versa. The period for the electrons to enter can be elongated by forming the RF to show positive and negative pulses with some elongated periods of zero voltage in between the pulses.

The electron beam is relatively strongly focused into a fine beam. This beam hits only the center of the ion cloud and over time completely discharges the ions in the center. Then ions from the outer region of the cloud replace the discharged ions in the center, until all ions are completely discharged without fragmenting the ions. To avoid this process, the end caps of the ion trap will be connected to a tickle voltage generator, delivering a low voltage (of a few volts only) with a frequency of some 10 kilohertz. The dipolar electric field generated by this tickle voltage has the effect, that the electron beam is swept to and fro in the frequency of the tickle voltage, mainly in the plane of the ring electrode. At the same time, the ions of the cloud are somewhat excited by the tickle voltage and start to oscillate with their secular frequency between the end caps. A scan of the tickle frequency (a "chirp") excites all ions of different masses. In this way, the electrons may be captured, over time, by the different ion types, without deleting only the ions in then center of the cloud.

The tickle voltage may also be a mixture of frequencies, exciting only the fragment ions, so that these fragment ions do no longer stay calmly in the center for further discharging.

The low energy electrons are trapped in the ion cloud by multiple, statistical deflections of their direction of flight caused by the coulomb field around the individual ions, a process which usually causes them to lose a small amount of kinetic energy each time. For energy reasons, they can no longer leave this ion cloud. They are ultimately captured by an ion to recombine with an ion charge if the direction of the electron flight path and the kinetic energy exactly match.

When electrons are caught by an ion, the charge state of the ion is decreased. One ionization site of the ion is neutralized. The doubly charged ion becomes a singly charged ion. This releases the ionization energy. (More precisely: the ions are predominantly protonated biomolecules. It is therefore the attachment energy of the proton, the so-called proton affinity energy, which is released). The energy released is absorbed in the ion and leads to a very definite cleavage between two amino acids, a so-called c-cleavage as a rule. Other ions of the same type may undergo a cleavage between two other amino acids. Statistically, a mixture of fragment ions is created whose length mirrors the complete chain of the amino acids, or at least a part of this chain.

The electron beam is switched off as soon as sufficient fragmentation has taken place. FIG. 5 shows how the doubly charged ions decrease and the singly charged ions (fragment ions) increase with time. This process cannot be continued for too long since, otherwise, the singly charged fragment ions recombine to form neutral particles. After switching off the electron beam and after a short settling period, the singly charged fragment ions are acquired as a mass spectrum in the usual way. The interpretation of this mass spectrum provides the sequence, or at least a partial sequence, of the amino acids in this peptide.

This method can then be repeated for other peptides in the mixture. This provides for extremely reliable identification of the protein. It is even possible to determine differences between the protein analyzed and those in protein sequence databases.

The fragmentation by electron capture which this invention makes possible possesses a number of advantages which are not immediately apparent:

Advantage a: since the storage of the original ions and their fragmentation is now possible with very low q in the Mathieu diagram, the secular motion of the ions is very slow. This, in turn, is very favorable for electron capture.

Advantage b: by fragmenting at low q (low RF voltage), all daughter ions down to those with low masses can be stored, because the threshold mass is now extremely low. This was not possible before because, for collision fragmentation, one had to work with a q of around 0.3, otherwise the collision energy would be too low and a fragmentation was frequently not possible. Only with very low q values is it possible to scan the complete amino acid fragment spectrum of the c-cleavages from a single amino acid upwards. Example: a large, doubly charged peptide with 20 amino acids has a molecular weight of around 2400 atomic mass units and a specific mass of m/z=1200 mass units per elementary charge. Daughter ions can normally be stored by collision fragmentation only at a threshold mass of approximately 400 mass units per elementary charge and upwards (corresponds to roughly three to four amino acids); with ECD, however, it is now possible, by selecting a very low q, to carry out storage of 80 mass units per elementary charge and upwards so that even the smallest, terminal, singly charged amino acids can still be collected.

Advantage c: the generation of the singly charged ions from doubly charged ones and the associated loss of singly charged ions is favorable, as can be seen in FIG. 5 (if the cross-sections for the electron capture do indeed behave as 4:1, which is still not certain). If the yield of the singly charged ions is approximately 50% of the original number of doubly charged ions, then the doubly charged ions have sunk to approx. 2–3%; they therefore no longer cause interference. Around 47% of the singly charged ions are lost as a result of neutralization; this is quite acceptable.

Advantage d: fragmentation is very rapid, it only takes a few milliseconds. This saves around 40–50 milliseconds fragmentation and damping time. This means that more daughter ion spectra can be scanned per unit of time, effectively increasing the sensitivity.

The method according to the invention naturally requires that the most favorable potentials of the ion emitter be initially adjusted for each setting of the RF voltage. A calibration curve is created experimentally for this purpose. The optimum data for the strength of the electron emission current and the duration of the electron beam operation are also determined experimentally.

The hole opposite the entrance aperture for the electrons in FIG. 1 serves to guide electrons which overshoot the potential saddle while the potential of the electron emitter is being set, out of the ion trap in order to avoid burn-in spots.

As the electrons penetrate into the ion trap, ions of the collision gas are, of course, also generated at this location by electron impact. Helium is normally used as the collision gas but other, low mass gases can also be used. The masses of the ions of these gases regularly lie below the storage threshold of the ion trap; the ions leave the ion trap within a very few RF periods, usually within one single period.

The method requires an ion trap mass spectrometer with at least one opening in the ring electrode, with an electron emitter for which the duration and the strength of the electron emission current can be adjusted, with a system of magnets for guiding the electrons and with an adjustable voltage supply for the emitter potential. A simple thermionic cathode, preferably a so-called hairpin cathode, can serve as the emitter. The strength of the current and the duration of the beam can be adjusted by means of a potential on either an aperture or a simple Wehnelt cylinder. The electron emission current to be adjusted is very small, as shown below. Since the RF voltage for a customary ion trap is in the range of 10 to 30 kilovolts, the emitter potential should be adjustable in the range of 100 to 1000 volts.

For a good spectrum, only around $10^4$ ions should ultimately remain in the ion cloud at the end since, otherwise, the mass resolution power will deteriorate as a result of the effect of the space charge. If one assumes approximately $2\times10^4$ doubly charged ions, then only approx. $3\times10^4$ electrons are required for the electron capture fragmentation in the cloud. The conditions which enable low energy electrons to access the ion cloud prevail only for the short duration of the maximum of the RF voltage. The duration amounts to only around 1% of the period of oscillation, i.e. around ten nanoseconds. Only approximately one percent of the electrons in the electron beam are therefore trapped. This means that approximately $3\times10^6$ electrons have to enter the ion trap volume. If one expects a loss of 99 percent of the ions between the thermionic cathode and the entrance to the ion trap volume, then around $3\times10^8$ electrons must be supplied by the thermionic cathode. If one wants to complete the process in one millisecond, one requires an electron emission current of approximately $3\times10^{11}$ electrons per second. This is an electron emission current of around 30 nanoamperes, i.e., extremely low, since, even with a very simple electron source it is easy to achieve electron emission currents of around 100 microamperes. Even with electron losses of a factor of 100 higher, the required electron emission current would be easy to generate.

Figure 6:
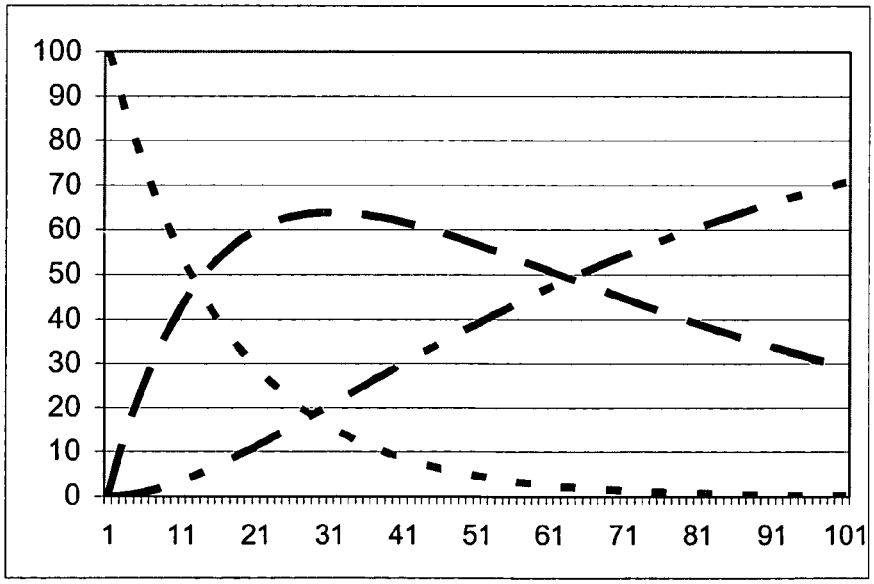
FIG. 6 shows the timing for the decrease of the doubly charged ions (dotted line), the increase of the neutral particles after double discharge (chain-dotted line) and the characteristic of the singly charged ions (dashed line).

In the case of fragmentation by means of electron capture on doubly charged ions, the destruction of a number of previously formed, singly charged fragment ions by further electron capture cannot be avoided. FIG. 6 shows estimated curves for the recombination (with fragmentation). The curves in FIG. 6 were calculated on the assumption that the capture cross-section for the recombination of doubly charged ions is larger by a factor of 4 than the capture cross-section for the recombination of singly charged ions. This enables a good compromise to be found between remaining doubly charged parent ions, singly charged fragment ions and ions destroyed by being completely discharged. It is, however, necessary to begin with a higher number of ions than are required for the fragment ion spectrum ultimately scanned. This must be taken into consideration when both storing and isolating the ions.

The electrons can also be injected through the end cap electrodes. In this case, however, the ring electrode must be grounded; the storage RF voltage must then be applied in-phase to both the end caps. The potential at the center of the trap then roughly follows the end cap potential with an attenuation factor of ⅗. Here too, an external magnetic field must be used to guide the electrons.

A specialist could also think of more complicated potential supplies which have the same effect of supplying the ion cloud in the center only with zero energy electrons, for example by setting the potential of the electron emitter also to an RF voltage. However, all these solutions are much more expensive than the solution to the problem suggested above, even though these more complicated solutions should be included in the basic idea of the invention.

What is claimed is:

1. Method for the fragmentation of ions in an RF ion trap mass spectrometer by the capture of low energy electrons (ECD), comprising the following steps:

(a) providing an RF ion trap with a ring electrode and two end cap electrodes, operated by an RF voltage, (b) providing an electron emitter outside the ion trap, (c) providing a pressure of damping gas inside the ion trap, (c) providing a cloud of selected parent ions inside the ion trap collecting in the center of the trap, (d) providing a magnetic field with field lines reaching from the electron emitter to the ion cloud, and (e) injecting electrons into the trap, whereby the electrons follow the magnetic field lines to the ion cloud.

2. Method according to claim 1, wherein the ring electrode is perforated, wherein the electron emitter is located in front of the ring perforation, and wherein the electron emitter is adjusted to a potential about equal to the highest positive potential in the center of the ion trap.

3. Method according to claim 1, wherein an end cap electrode is perforated, wherein the electron emitter is located in front of the end cap perforation, and wherein the electron emitter is adjusted to a potential about equal to the highest positive potential in the center of the ion trap.

4. Method according to claim 1, wherein the electron emitter is located in front of a gap between an end cap electrode and the ring electrode, and wherein the electron emitter is adjusted to about the ground potential of the ion trap.

5. Method according to claim 1, wherein the magnetic field is generated by permanent magnets and a yoke.

6. Method according to claim 1, wherein the magnetic field is generated by an electromagnet, and the magnetic field is switched off when the fragmentation process is finished.

7. Method according to claim 1, wherein a tickle voltage of a frequency of some ten kilohertz is applied to the end cap electrodes.

8. Method according to claim 7, wherein the tickle voltage consists of different frequencies, either applied synchronously or sequentially in time.

9. Method according to claim 1, wherein the emission of the electron beam is controlled and limited to the most favorable phase of the RF voltage operating the ion trap.

10. Ion trap mass spectrometer apparatus, comprising (a) an RF ion trap mass spectrometer, (b) an electron emitter for the generation of an electron beam outside the ion trap, and (c) a magnetic field generator for the generation of a magnetic field the field lines of which reach from the electron emitter to the center of the ion trap.

11. Ion trap mass spectrometer apparatus according to claim 10 wherein the magnetic field generator comprises a system of permanent magnets, electromagnets or a combination thereof.

* * * * *